US005230165A

United States Patent [19]

Beisswanger

[11] Patent Number: 5,230,165

[45] Date of Patent: Jul. 27, 1993

[54] DRYER SECTION

[75] Inventor: Rudolf Beisswanger, Steinheim, Fed. Rep. of Germany

[73] Assignee: J. M. Voith GmbH, Fed. Rep. of Germany

[21] Appl. No.: 862,194

[22] Filed: Apr. 2, 1992

[30] Foreign Application Priority Data

Apr. 4, 1991 [DE] Fed. Rep. of Germany ..... 4110875

[51] Int. Cl.[5] ..... F26B 19/00

[52] U.S. Cl. ..... 34/60; 34/18; 34/42; 34/156

[58] Field of Search ..... 34/156, 155, 10, 18, 34/42, 60, 160; 118/643

[56] References Cited

U.S. PATENT DOCUMENTS 3,403,456 10/1968 Smith, Jr. ..... 34/18 X
4,674,976 6/1987 Naohara et al. ..... 34/156 X
4,837,946 6/1989 Hella et al. ..... 34/156

*Primary Examiner*—Henry A. Bennet

*Attorney, Agent, or Firm*—Baker & Daniels

[57] ABSTRACT

A web guiding structure in a drying section downstream from a coating device, and having suspension and infrared dryers and with a directly preceding coating device for paper or board. A rigid beam-like chest-like web bend device with blowing elements is adapted to produce a pressurized gas cushion for the web for contact-free bending of the web in its direction through an angle between 50° and 120°, so that with an increase in its distance from the bending device, the web also moves away from the coating device. Following the bend device a heating device or a suspension device having beam-like, chest-like blowing air guide devices in each case produces a course of the web undulating in the direction of movement of the web (web valleys and crests extending in the transverse direction) on the upper and lower sides of the web. Further dryers are included, with radiation and/or a hot gas action, and are alternately arranged with drying devices in the form of infrared dryers and suspension dryers, alternating at least twice.

12 Claims, 2 Drawing Sheets

DRYER SECTION

BACKGROUND OF THE INVENTION

The invention relates to a web guiding structure in a drying section, downstream from a coating device and having suspension and infrared dryers. Such a device is described in the German patent publication 3,910,898 A, so that the combination of infrared and suspension dryers is known.

One object of the invention is connected with the problem of so guiding the web of paper or board after coating thereof, while it still has a moisture content of approximately 30%, that the web is dried and the web is subjected to minimum stresses and only has a minimum tendency to form folds, more particularly in the longitudinal direction. There has been a proposal in the European patent 236,819 to bend a web relatively sharply along an arc in a contact-free manner by a rigid, beam-like air chest with air blowing elements in order to prevent the wet material of the coating composition sticking to a roll as is otherwise utilized for bending and guiding the web.

The object of substantially reducing web corrugations in the transverse direction and of preventing the development of folds is to be attained using the features of the present invention. Web corrugation in the transverse direction means that the corrugations (crests and troughs) follow each other in the transverse direction of the web.

In order to better stabilize the course of the web it is possible to provide a beam-like air plenum or chest with jets upstream from the deflecting device, and directed against the outer side of the web arc.

Preferably this beam-like device is curved, there then additionally being a more powerful blowing action at the center of the web than at its edges so that there is a more pronounced curvature or bending in the center than at the edges and therefore a tendency to stretch it in the breadth direction.

Furthermore, it is appropriate as well if the drying is substantially performed to completion, there being an alternating succession of infrared and suspension dryers, an optimum maximum drying being achieved in the shortest possible distance.

Although there has been a proposal in the European patent publication 0 291 832 to have an alternating succession of infrared and suspension dryers, this was not for the same purpose as in the present invention, that is to say smoothing the web by guiding at along an undulating path. Accordingly, the suspension dryers in this case have such a design that the web is not caused to undulate but is rather more guided along a straight path at a very regular distance from the infrared dryers in order to make best use of their heating effect. After each infrared dryer a suspension dryer is arranged for the removal of the water vapor, which is formed under each infrared dryer. The dryers are arranged on only one side of the web.

SUMMARY OF THE INVENTION

In the invention the longitudinal undulation of the web (i.e. waviness in the longitudinal direction of the web) causes stiffness in the transverse direction of the web in the initial part of drying, that is to say prior to the subsequent dryer group designed with drying cylinders, so that waviness or corrugation in the transverse direction of the web is reduced and the formation of folds is prevented.

BRIEF DESCRIPTION OF THE DRAWINGS

The invention will be described with reference to the embodiments illustrated in drawings.

DESCRIPTION OF THE PREFERRED EMBODIMENT

Figure 1:
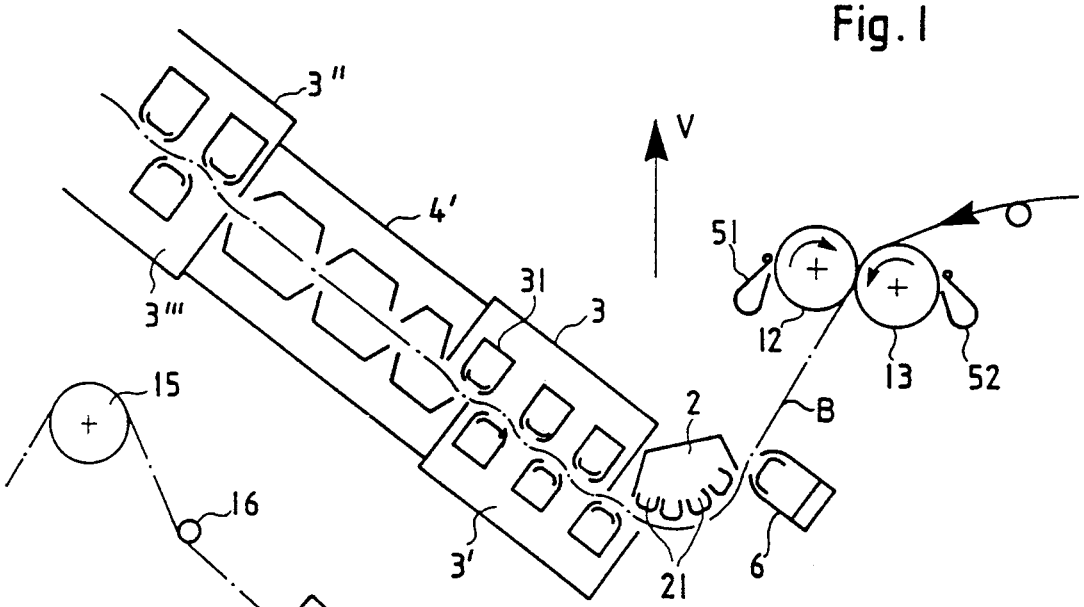
FIGS. 1, 2, and 5 show three overall arrangements in principle.

As shown in FIG. 1 the web B is moved through a coating device which for instance comprises two pressing rolls 12 and 13 and each of which has an application device 51, 52, respectively, for a coating composition. The vertical direction is in this case denoted by V and it extends essentially parallel to the longitudinal edges of the plane of the drawing. At an angle of between 25° and 45° the web is drawn downwards following the coating device and firstly passes to a web stabilizing device 6, and thereafter a web bending or deflecting device 2 using air and having blowing jets 21 arranged along an arc in a row side by side.

Due to the tension of the web and the air pressure of the blown air from the web bending device 2, the web is guided onwards in an arc without making contact and then arrives in a suspension drying device 3, which has blowing devices 23 as well. On the other side there is also a similar suspension drying device 3'. The blowing devices 23 of the two suspension drying devices ar arranged opposite to each other with an offset so that the web moves along a sinusoidal path in a known manner. The temperature of the blown air is preferably between 150° and 300° C., although it may be at room temperature, in which case it is no longer a question of a suspended web drying device but of a simple suspended web guiding device. Preferably, however, air at a temperature substantially above normal is used so that the web is dried as well.

The blowing devices have lateral slots for the emergence of the air, which extend adjacent to the pressure surface 31 for the air cushion. Between the blowing device the air is removed again (see U.S. Pat. No. 4,833,794).

The purpose of the undulating path of the web in this portion is to prevent the waves produced due to transverse shrinkage of the web, which is relatively moist after leaving the coating device, from becoming larger or turning into folds. Furthermore the action of the web stabilizer 6 and of the contact-free web bending device 2 is to considerably reduce this waviness in the transverse direction which is due to the extension of the web. Then following the suspension dryers 3 and 3' there is an infrared dryer 4', which in turn is followed by suspension dryers 3'' and 3''' with blowing devices offset in relation to each other in the direction of movement of the web. Such blowing devices are essentially in the form of chests of beams and are of known design, see for instance the U.S. Pat. No. 4,833,794. The contact-free web bend device 2 allowing for the "air turn" may be, for instance, as described in the European patent publication 0 236 819 A1.

The waviness of the web in the suspension dryers 3, 3' and respectively, 3''' or the sine wave form thereof should have a wavelength of between 20 and 60 cm and preferably between 20 and 40 cm.

Figure 2:
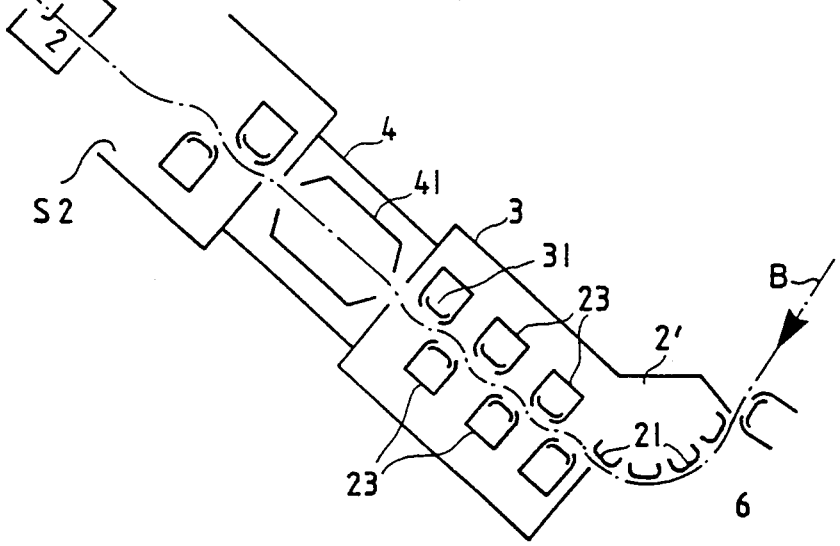

FIG. 2 furthermore indicates that suspension drying units 3 and infrared units 4 are arranged in alternate succession, the last infrared unit being reference $I_2$ and the last suspension drying unit being reference $S_2$. After this, the web is diverted onto a breadth stretching or tentering roll 16 and passed to the first drying cylinder 15, which is followed by further drying cylinders in a known manner. The angle to the vertical V at which the web is moved upwards after bending preferably amounts to between 40° and 65°. The web bands as it passes through web bend device 2 at a bend angle of between 50° and 120°.

The first blowing device 23 of the suspension device on the outside of the arc in this case directs air radially inwards against the convex side of the web B so that the web, or respectively the course thereof, is completely regular at the end of the arc as well.

Figure 3:
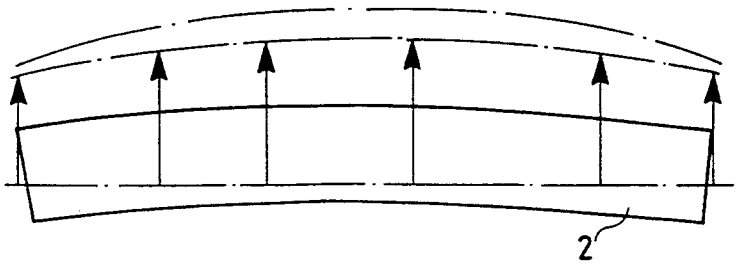
FIGS. 3 and 4 show in principle two contact-free web bending devices based on the use of air.

FIG. 3 illustrates that the contact-free web bending device 2 is made in the form of a curve so that in the middle of the deflection arc the web is more deflected than towards the margin thereof. Furthermore the pressure of blowing is made higher in the middle than towards the edge so that the web assumes the form shown in broken lines in an exaggerated manner. This in addition enhances the effect of reducing the formation of waves transversely in relation to the course of the web and preventing the formation of folds. The curvature is in this case naturally shown with some exaggeration.

It is furthermore possible to adopt only the one or the other measure. The difference in the blowing pressure between the middle and the edge should amount to approximately 20% and the curvature to between 5 and 10 times the width of the web.

Figures 4, 5:
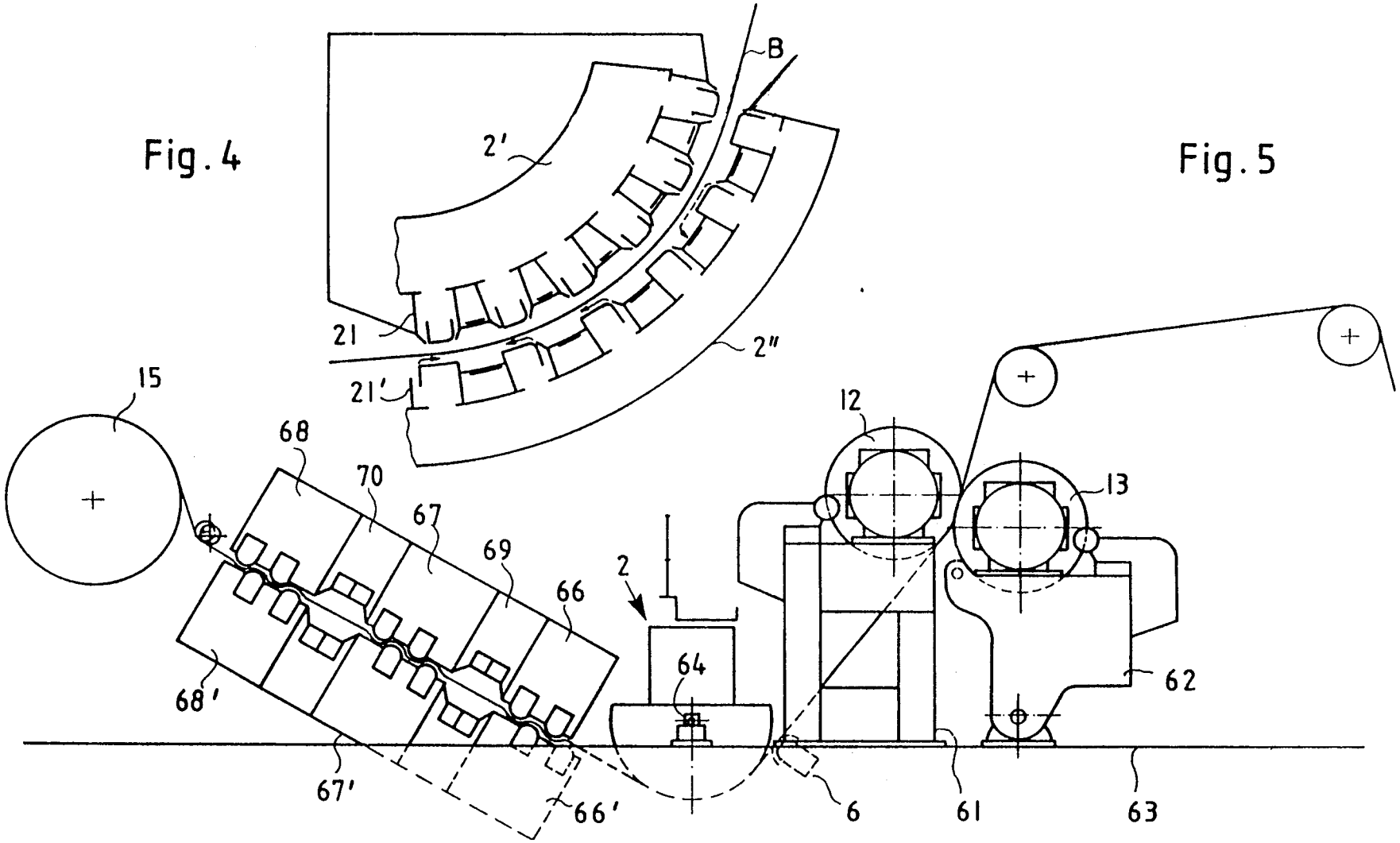

The bend device 2'' with blowing nozzles in accordance with FIG. 4 furthermore has blowing device 21' radially on the outside of the arc of the web; in this case air is utilized and drying of the web may commence here on both sides.

The effect described in the above is also produced by a stretching of the web in the width direction in this case, and a further purpose of the arrangement is to cause an even greater stabilization of the web.

FIG. 5 shows the overall arrangement in a practical form thereof, the preferred arrangement being so designed with regard to the removal of moisture that the last heating dryer 68 arranged upstream from the drying roll 15 of the following drying roll group is constituted by a suspension dryer.

The suspension dryers are denoted 66 through 68 and 66' through 68', the infrared dryers 69 and 70, the bearing units for the coating rolls 12, 13 are shown as 61 and 62, respectively, and the floor of the machine as 63. The contact-free bend device 2 is mounted by means of bearings on the foundation of the machine.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A guiding structure for guiding a web in a direction of travel in a drying section of a machine for making paper or board, said guiding structure being situated directly downstream from a coating device in said machine, and including suspension and infrared dryers in said drying section, said guiding structure comprising;

a generally rigid beam-like chest-like web bend device having blowing elements adapted to produce a pressurized gas cushion for the web for contact-free bending of the web as it passes through said web bend device, said web bend device oriented in said machine so that the web passes through said web bend device after passing through said coating section, said web bending at an angle between 50° and 120° as it passe through said device;

a suspension drying device situated following the web bend device in the direction of travel of the web, said drying device having beam-like chest-like blowing air guide devices for blowing air on the upper and lower sides of the web and thereby producing an undulating course for the web in said direction of travel of the web; and alternately arranged drying devices in the form of infrared drying devices and suspension drying devices positioned downstream from said first-mentioned suspension drying device along the direction of travel of the web, said drying devices being arranged so that said guiding structure includes at least two suspension drying devices and two infrared drying devices alternately arranged so that an infrared drying device is positioned between two suspension drying devices.

2. The structure of claim 1, wherein at least one beam-like, chest-like blowing air guide device is provided opposite to the web side supported in the form of an arc, said blowing air guide device being adapted to direct air jets or an air cushion against the arc of the web on the outer side thereof essentially upstream from the first blowing element in the direction of web travel.

3. The structure of claim 1, wherein the last one of said alternately arranged drying devices downstream from said bend device along the direction of travel of the web is a suspension drying device, and wherein said suspension drying devices are structured and arranged in said guide structure to provide an undulating course of the web.

4. The structure of claim 1, including a beam-like air guide device arranged upstream from said web bend device, said beam-like air guide device being adapted to produce gas jets in the direction of movement of the web, thereby causing a wave in the web at the beginning of the bend devices.

5. The structure of claim 4, wherein said web bend device is adapted to produce a blowing pressure intensity which gradually decreases from the middle of the web towards the edges thereof, said device having a generally curved profile in accordance with an analogous course over the breadth of the web.

6. The structure of claim 2, wherein the first suspension drying device following said web bend device is arranged at the inner side of the web and constitutes a constructional unit with the same, at least as regards the one side of the web, and is arranged with the same so that a first air blowing device of a complementary suspension drying device, arranged on the outer side of the web, produces a wave arc with the opposite curvature to that of the arc which is generated by the bend device.

7. The structure of claim 1, wherein the inclination of the web during travel through the drying section is firstly such that following the coating device the web is inclined downwardly, and following the air bend device the web is inclined upwardly.

8. The structure of claim 1, wherein a breadth stretching roll follows the dryers, and thereafter along the direction of travel of said web follows the first one of a series of drying cylinders, the tension in the web in the portion of said web extending between the coating device and the breadth stretching roll being considerably reduced, and substantially increasing again only after the drying cylinder.

9. The structure of claim 1, wherein the web is adapted to pass through the heating devices in an ascending path.

10. A guiding structure for guiding a web in a direction of travel in a drying section of a machine for making paper or board, said guiding structure being situated directly downstream from a coating device in said machine, and including suspension and infrared dryers in said drying section, said guiding structure comprising;

a generally rigid beam-like chest-like web bend device having blowing elements adapted to produce a pressurized gas cushion for the web for contact-free bending of the web as it passes through said web bend device, said web bend device oriented in said machine so that the web passes through said web band device after passing through said coating section, said web bending at an angle between 50° and 120° as it passes through said device;

a suspension drying device situated following the web bend device in the direction of travel of the web, said drying device having beam-like chest-like blowing air guide devices for blowing air on the upper and lower sides of the web and thereby producing an undulating course for the web in said direction of travel of the web; and alternately arranged drying devices in the form of infrared drying devices and suspension drying devices positioned downstream from said first-mentioned suspension drying device along the direction of travel of the web, said drying devices being arranged so that said guiding structure includes at least two suspension drying devices and two infrared drying devices alternately arranged so that an infrared drying device is positioned between two suspension drying devices, said web being adapted to pass through the drying devices in an ascending path.

11. The structure of claim 10, wherein the inclination of the web during travel through the guiding structure is firstly such that following the coating device the web is inclined downwardly, and following the bend device the web is inclined upwardly in said ascending path.

12. A guiding structure for guiding a web in a direction of travel in a drying section of a machine for making paper or board, said guiding structure being situated directly downstream from a coating device in said machine, and including suspension and infrared dryers in said drying section, said guiding structure comprising;

a generally rigid beam-like chest-like web bend device having blowing elements adapted to produce a pressurized gas cushion for the web for contact-free bending of the web as it passes through said web bend device, said web bend device oriented in said machine so that the web passes through said web bend device after passing through said coating section, said web bending at an angle between 50° and 120° as it passes through said device;

a suspension drying device situated following the web bend device in the direction of travel of the web, said drying device having beam-like chest-like blowing air guide devices for blowing air on the upper and lower sides of the web and thereby producing an undulating course for the web in said direction of travel of the web;

alternately arranged drying devices in the form of infrared drying devices and suspension drying devices positioned downstream from said first-mentioned suspension drying device along the direction of travel of the web, said drying devices being arranged so that said guiding structure includes at least two suspension drying devices and two infrared drying devices alternately arranged so that an infrared drying device is positioned between two suspension drying devices; and a beam-like air guide device arranged upstream from said web bend device, said beam-like air guide device being adapted to produce gas jets in the direction of movement of the web, thereby causing a wave in the web at the beginning of the bend devices; said web bend device being adapted to produce a blowing pressure intensity which gradually decreases from the middle of the web towards the edges thereof, said device having a generally curved profile in accordance with an analogous course over the breadth of the web.

* * * * *